US007441568B2

(12) United States Patent
Porter et al.

(10) Patent No.: US 7,441,568 B2
(45) Date of Patent: Oct. 28, 2008

(54) RECHARGEABLE DISPENSING HEAD

(75) Inventors: George O. Porter, Suwanee, GA (US); Leslie J. Varga, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 11/743,381

(22) Filed: May 2, 2007

(65) Prior Publication Data

US 2007/0205215 A1 Sep. 6, 2007

Related U.S. Application Data

(62) Division of application No. 10/896,105, filed on Jul. 21, 2004, now Pat. No. 7,237,578.

(51) Int. Cl.
*B65B 1/04* (2006.01)

(52) U.S. Cl. ..... 141/11; 141/82; 141/95; 141/198; 141/352

(58) Field of Classification Search ..... 141/11, 141/69, 82, 94, 95, 192, 198, 346–352; 222/1, 222/590, 591, 593, 64, 146.2
See application file for complete search history.

(56) References Cited

U.S. PATENT DOCUMENTS 4,099,653 A * 7/1978 Scholl et al. ..... 222/146.5
4,144,913 A 3/1979 Akers et al.
4,303,108 A 12/1981 Akers et al.
4,505,406 A * 3/1985 Cobbs et al. ..... 222/135
4,535,919 A * 8/1985 Jameson ..... 222/190
4,545,504 A * 10/1985 Fabel et al. ..... 222/55
4,682,711 A 7/1987 Reighard et al.
4,898,302 A * 2/1990 Byerly et al. ..... 222/49
5,123,569 A 6/1992 Lindner
5,318,207 A 6/1994 Porter et al.
5,747,102 A 5/1998 Smith et al.
6,095,803 A * 8/2000 Slater ..... 432/13
2004/0029980 A1 2/2004 Stumphauzer et al.

* cited by examiner

*Primary Examiner*—Timothy L Maust
(74) *Attorney, Agent, or Firm*—Wood, Herron & Evans, L.L.P.

(57) ABSTRACT

An adhesive liquid dispensing apparatus includes a gun manifold, a dispensing module, and a dispensing orifice. The inlet port of the gun manifold is directly coupled with a reservoir of adhesive hot melt liquid that is fixedly attached to the manifold. The contents of the reservoir are under pressure so that the adhesive hot melt liquid is dispensed from the adhesive liquid dispensing apparatus without the need for heated supply hoses to connect the inlet port of the manifold to a remote source of adhesive hot melt liquid. Preferably, the adhesive liquid dispensing system is coupled with a robot that controls the positioning of the system during an adhesive liquid dispensing operation.

8 Claims, 2 Drawing Sheets

RECHARGEABLE DISPENSING HEAD

This application is a divisional of application Ser. No. 10/896,105, filed Jul. 21, 2004 (pending), which is hereby incorporated by reference herein in its entirety.

FIELD OF THE INVENTION

The present invention relates to adhesive liquid dispensing systems, and more particularly, with robotically-controlled systems that dispense an adhesive hot melt liquid.

BACKGROUND OF THE INVENTION

Viscous liquids are applied by dispensers onto substrates in a variety of dispensing applications employed in the manufacture of products and product packaging. These viscous liquids include thermoplastic materials such as hot melt adhesives. Liquid dispensers utilize pneumatically or electrically actuated valve assemblies for metering a precise quantity of the viscous liquid and discharging the metered amount through a discharge outlet. Many thermoplastic materials exist in a solid form at room or ambient temperature and must be heated to create a flowable viscous liquid. Typically, the solid form of material is placed in a holding tank having heated walls and is melted by heating the solid material above its melting point. The viscous liquid is pumped in a molten state under pressure from the holding tank through a supply conduit to a manifold block. The manifold block has liquid passageways connected in liquid communication with the dispensing orifice of one or more liquid dispensers.

Such liquid dispensers, consisting of a manifold and a dispensing module, can often be mounted on small, or tabletop, robots that are controlled to accurately position the dispenser and to precisely meter the application of a viscous liquid, such as adhesive, solder, underfill material, or other liquids. The dispensers are also coupled with a supply line that provides the liquid under pressure from an appropriate supply. In most applications involving the dispensing of a heated viscous liquid, the liquid supply line will be warmed by heating elements to compensate for heat loss as the liquid travels from the liquid supply source to the liquid dispensing module. Thus, the liquid supply lines are bulky in order to withstand the pressure of the liquid and, additionally, include integral heating elements that add to both the size and weight of the supply lines.

As a result, the robot that controls the movement of the liquid dispenser is sized to handle the weight of the liquid supply lines, not just the liquid dispenser. Furthermore, the additional weight of the liquid supply lines limits the speed at which the robot can move because of increased inertia that adversely affects the precision of robot positioning at higher speeds. The presence of heated liquid supply lines must also be considered when designing a workspace for a liquid dispensing system as the supply lines must extend from the liquid dispenser to the heated holding tank without interference.

In the past some liquid dispensing systems have included a dispenser having a replaceable cartridge that can be periodically replaced by an operator when empty. To be practical, such an approach requires the replaceable cartridges to be manufacturable at an economic cost and available at sufficient quantities so as to not adversely affect operation of the liquid dispensing system. Thus, such a cartridge approach has not been used within an adhesive hot melt liquid dispenser environment.

Accordingly, a need exists for a robot-mounted liquid dispenser, particularly an adhesive hot melt liquid dispenser that does not utilize a liquid supply line to couple the liquid dispenser to a remote liquid source, such as a tank. Satisfaction of this need would provide such benefits as removing hoses and swivels in a work area, improving robot dexterity, and reducing the overall tooling load of the robot and, thus, its required size. Additionally, supply hoses can be avoided that have flexibility and resiliency which sometimes cause surges in the amount and pressure of liquid arriving at a manifold resulting in inaccurate liquid metering.

SUMMARY OF THE INVENTION

Accordingly, aspects of the present invention relate to a method for operating an adhesive liquid dispensing apparatus having an adhesive liquid reservoir in fluid communication with a dispenser having a dispensing orifice. The dispenser is preferably a gun with a manifold and a dispensing module which includes the dispensing orifice. In accordance with this method, adhesive liquid is supplied from the liquid reservoir to the dispenser while the dispenser is dispensing the liquid. When a reduced liquid level within the reservoir is detected, the reservoir and dispenser are coupled to a docking station and then the reservoir is refilled with additional adhesive liquid. Also, a desired temperature of the adhesive liquid may be maintained within the reservoir. The attachment of the adhesive liquid reservoir to the dispenser, and preferably to the gun manifold, eliminates the need for heated hoses and the temperature and level detectors permit continued operation of the dispensing apparatus.

Another aspect of the present invention relates to an adhesive liquid dispensing system that includes a liquid dispensing apparatus, having an inlet port; and a reservoir fixedly coupled with the liquid dispensing apparatus, having an opening in communication with the inlet port. Furthermore, the reservoir contains a viscous liquid under pressure so as to cause the viscous liquid to enter the liquid dispensing apparatus through the inlet port. The system also includes a heating element operatively coupled with the reservoir and configured to maintain the reservoir at a temperature, such as the set point temperature of the liquid adhesive. A robot is preferably coupled with the liquid dispensing apparatus and configured to position the liquid dispensing apparatus.

These and other features, objects and advantages of the invention will become more readily apparent to those of ordinary skill in the art upon review of the following detailed description, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
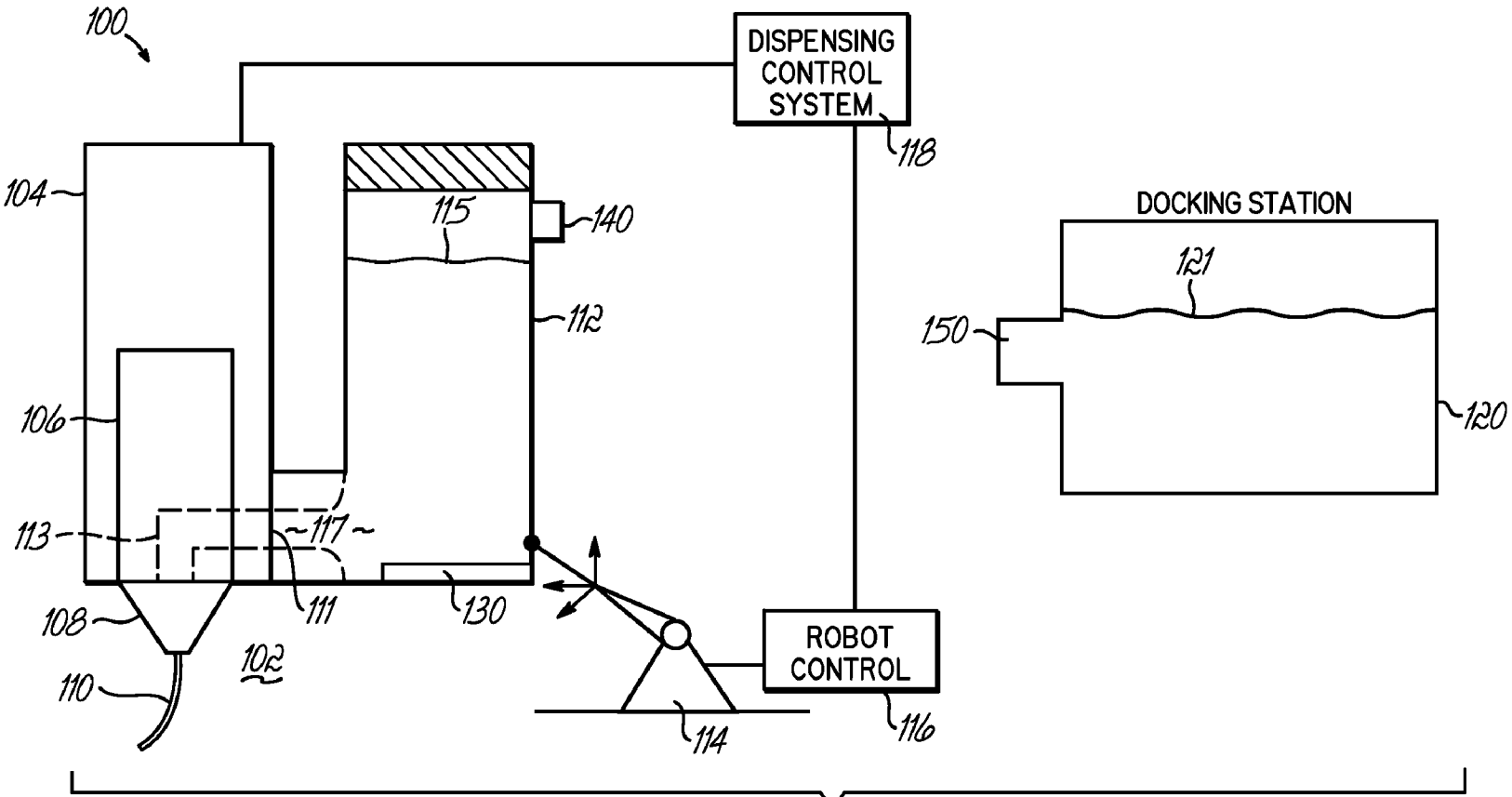
FIG. 1 schematically illustrates a liquid dispensing system according to one embodiment of the present invention.

The liquid dispensing apparatus 100 of FIG. 1 and the description that follows focuses on the hot melt reservoir 112 that eliminates the need for heated liquid supply hoses to be connected to the manifold 104. Current dispensing systems that are robotically controlled may benefit from the embodiments described herein. Accordingly, a brief description of such liquid dispensing systems is presented by way of introduction. For example, one exemplary liquid dispensing system developed by the present Assignee includes a product line referred to as the Pro-Meter™ System. This system is designed to robotically dispense high viscosity adhesives, including urethanes, silicones, butyls, and hot melt materials. The system typically consists of a gear pump, a dispensing module, and a system controller. It is designed to automatically adjust material flow in proportion to the robot speed while in use. The Pro-Meter™ system reacts to an analog signal sent from the robot controller that is proportional to the robot's speed. The Pro-Meter™ controller automatically adjusts the gear pump material output proportional to the analog signal. This provides uniform deposition of the adhesive bead as the robot accelerates and decelerates through its programmed path. Because the viscosity of adhesives can vary due to temperature, thinning, and batch-to-batch differences, to maintain consistent material output, the Pro-Meter™ system incorporates a positive displacement gear pump along with advanced closed-loop controls to provide precise volumetric output. The detailed operation of this system is not critical to the understanding of the present invention; but, instead, is an exemplary liquid dispensing system that benefits from the lighter robot weight load, the more uniform delivery of liquid to the manifold, and the increased robot dexterity that results from removing the heated liquid supply hoses that have historically been connected to robotic liquid dispensing systems.

FIG. 1 illustrates a schematic view of an embodiment of the present invention. The liquid dispensing apparatus 100 includes a dispensing apparatus 102 that is a combination of a number of components. The gun manifold 104 and dispensing module 106 are conventional parts of a dispensing system such as the Pro-Meter™ system described above. Thus, the manifold 104 can include servo motors, planetary gear boxes, gear pumps, and solenoid actuators that accurately and precisely meter a liquid 110 out of the dispensing orifice 108 of the dispensing gun 106. Other equivalent manifolds 104 and dispensing modules 106 are also contemplated within the scope of the present invention.

The manifold 104 includes an inlet port 111 by which the hot melt liquid enters the manifold 104; the inlet port 111 is in fluid communication with a passageway 113 of the dispensing module 106 that permits the liquid to reach the exit orifice 108. Typically, the inlet port 111 has been connected to a high-pressure, heated hose that provides the hot melt liquid under pressure to the manifold 104. As previously described, these hoses are awkward and bulky in systems in which the dispensing apparatus 102 is robotically manipulated when dispensing liquid.

As shown in FIG. 1, however, the dispensing apparatus 102 includes, instead of these hoses, a reservoir 112 that holds hot melt liquid 115 or other liquid formulations. For example, the reservoir may include a heat exchanger for converting liquid polymer formulations (e.g., LIQUAMELT™) to a hot melt and, therefore, also include either dynamic, or static, mixing elements. The U.S. published patent application 2004/0029980 A1 provides an example of such a composition and its disclosure is hereby incorporated by reference in its entirety. Accordingly, the hot melt liquid 115 referred to herein encompasses both conventional hot melt liquids or liquid polymer formulations. The reservoir 112 is attached to the manifold 104 so that the hot melt liquid 115 can enter a passageway 117 within the reservoir 112 and be delivered to the inlet port 111 of the manifold 104. Thus, the reservoir 112 and the hot melt liquid 115 replace the conventional heated, liquid supply hoses used in prior art dispensing systems. As for the reservoir 112, it can be integrally formed with the manifold 104 or can be realeasably attached through the use of bolts or similar fasteners. The reservoir 112 also includes a heating device 130, such as a peltier device, or other electric heater, to maintain the hot melt liquid 115 in its molten state. As for size, an exemplary embodiment of the invention uses a reservoir 112 that is between 1 and 3 liters in volume. Because hot melt adhesive is typically metered out in bead sizes of between ¼ mm to 2 mm, a reservoir 112 can dispense a large amount of adhesive before emptying while not being so heavy as to impact the dexterity of the robot 114.

The flow of hot melt liquid through the dispensing apparatus 102 relies on the liquid 115 entering the manifold to be under pressure. Accordingly a valve 140 is included in the reservoir 112 that permits an outside source of compressed air or $N_2$ to supply pressure to the reservoir 112. Typically, the valve 140 would be connected by hose to a source (not shown) of compressed gas. The compressed gas hose that connects with the valve 140 is lightweight, small and unheated and does not significantly contribute to the weight loading of the robot 114.

As just mentioned, the apparatus 100 of FIG. 1 also includes a robot 114 and a robot control system 116. A skilled artisan would recognize that a number of different robots and control systems can be utilized to control the movement of the dispensing apparatus 102. Typical table-top robots that are used in hot melt adhesive applications have a work envelope of 300 mm×300 mm in the X-Y axis and 0-250 mm in the Z axis. Although, larger work areas such as 500 mm×500 mm in the X-Y axis are contemplated as well. These robots perform optimally when the weight loading is around 10 lbs but function adequately with loads of up to 30 lbs. Of course, such robotic specifications are exemplary in nature only, and the dispensing apparatus with a liquid reservoir in accordance with the principles of the present invention can operate with a wide variety of different sized robots.

A dispensing control system 118 is connected with the dispensing apparatus 102 and the robot control system 116. In the Pro-Meter™ Dispensing system described earlier, the dispensing control system 118 is a microcontroller based platform that is programmable so as to create different application routines for dispensing liquid. The control system 118 receives input from the robot control regarding speed, for example, and controls the speed of a servo-motor so that liquid 110 is dispensed in a controlled manner. The microcontroller also includes a number of generic input and output ports so that customized applications can be developed. Many different dispensing control systems and algorithms are known in the art and will not be described in detail herein. However, one aspect that does relate to the present invention is that the dispensing control system will include the capability to receive an input signal that is indicative that the reservoir 112 is empty.

When the dispensing control system 118 detects that the reservoir 112 is empty of hot melt liquid 115, then the dispensing control system 118 instructs the robot control system 116 to relocate the dispensing apparatus 102 near the heated docking station 120 that holds more hot melt liquid 121. Once the robot 114 has positioned the dispensing apparatus 102 near the docking station 120, the robot 114 can then cause the reservoir 112 to engage the docking station 120 via a port 150 so that the reservoir 112 can be refilled. Once the reservoir 112 is refilled, the dispensing apparatus 102 can return to its application of hot melt adhesive or other liquid.

According to one embodiment of the present invention, conventional hot melt adhesives are those polymeric materials which are normally solid at room or ambient temperature but, when heated, are converted to a liquid state. Hot melt adhesives are supplied to manifold 104 at pressures ranging from about 200 p.s.i. to about 1200 p.s.i. and at a temperature between about 250° F. and about 350° F. In this temperature range, the viscosity of the liquefied hot melt adhesive ranges between about 700 and about 100,000 centipoise, typically about 2,000 to about 50,000 centipoise. In addition, as described earlier, alternative embodiments of the present invention contemplate using liquid polymer formulations that are a free-flowing liquid at room temperature that is converted to a hot melt when heated (such as by a heat exchanger).

Figure 2:
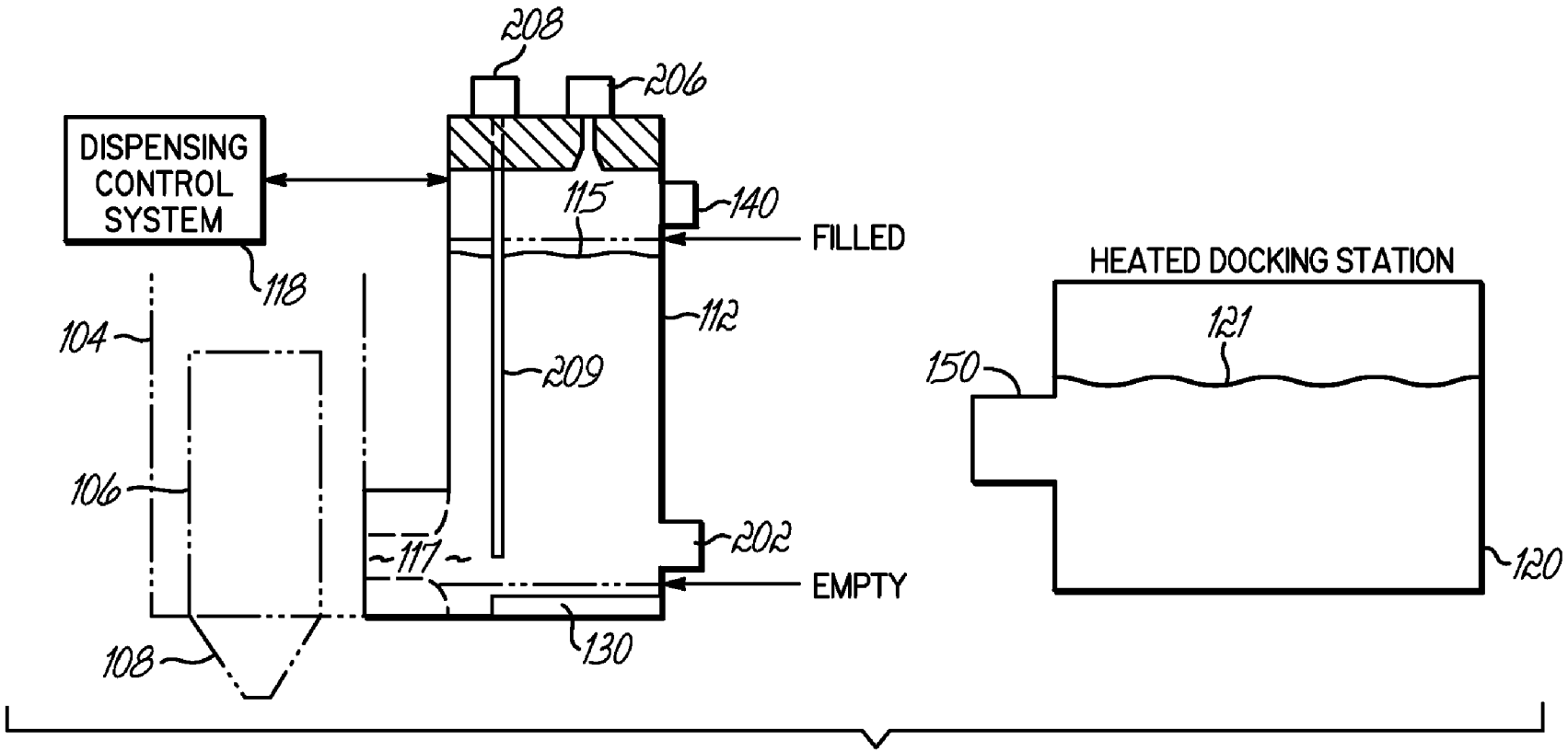
FIG. 2 illustrates a more detailed schematic view of the reservoir and docking station of FIG. 1.

FIG. 2 illustrates a more detailed view of those elements of the reservoir 112 and the docking station 120 that are involved with refilling the reservoir once it is empty. First, the reservoir 112 includes a level sensor 208. One typical level sensor 208 would include a portion 209 that extends nearly the entire depth of the reservoir 112 and would complete an electric circuit through the hot melt liquid 115 in the reservoir 112. By measuring an electrical parameter, such as resistance or capacitance, the depth sensor 208 estimates the level of liquid 115 that is present. Other sensing methods, such as sonic or ultrasonic returns can be used as well to measure the level of the liquid 115. As already described, when the sensor 208 detects that the reservoir 112 needs to be refilled it sends a signal to the dispensing control system 118 (and the robot control 116) that results in the reservoir 112 being docked with the docking station 120.

The reservoir 112 includes a recharging port 202 that communicates with a connecting port 150 on the docking station 120. The reservoir 112 also includes a vent valve 206 that can be controlled by a solenoid and the pressure valve 140 that is also controlled by a solenoid. Once the reservoir 112 is docked with the docking station 120, the dispensing control system 118 controls the solenoids so that the reservoir 112 can be recharged.

In particular, the pressurized gas valve 140 is closed and the vent valve 206 is opened. Under these circumstances, the docking station 120 can pump hot melt liquid into the reservoir 112 once the recharging port 202 is opened. Alternatively, the connecting port 150 is located such that gravity provides sufficient pressure to fill the reservoir 112. With the recharging port 202 opened, hot melt liquid flows from the connecting port 150 into the reservoir 112 until the level sensor 208 detects that filling sequence should stop. In response, the connecting port 150 is then closed, the recharging port 202 is closed, and the vent valve 206 is closed as well. The pressurized gas valve 140 is now reopened so that the hot melt liquid 115 in the reservoir 112 is once again under pressure. With the reservoir 112 refilled, the dispensing apparatus, as controlled by the robot 114 and the dispensing control system 118, is once again ready to dispense hot melt liquid.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

What is claimed is:

1. A method for operating an adhesive liquid dispensing apparatus having an adhesive liquid reservoir coupled in fluid communication with a dispenser having a dispensing orifice, the method comprising:

supplying liquid from the reservoir to the dispenser while dispensing the adhesive liquid from the dispenser;

detecting a reduced adhesive liquid level within the reservoir;

upon detecting the reduced adhesive liquid level, automatically moving the reservoir and the dispenser to a docking station; and refilling the reservoir with additional adhesive liquid transferred from the docking station to the reservoir.

2. The method of claim 1, further comprising:

coupling a recharge valve on the reservoir with a connecting port on the docking station;

relieving pressure within the reservoir; and opening the recharge valve.

3. The method of claim 2, further comprising:

detecting when the reservoir is full of the additional liquid;

closing the recharge valve so as stop receiving additional liquid within the reservoir; and pressurizing the reservoir.

4. The method of claim 1, further comprising:

detecting the temperature of the liquid in the reservoir; and maintaining the temperature of the liquid in the reservoir in a predetermined range.

5. The method of claim 1, further comprising:

operatively coupling the adhesive liquid dispensing apparatus to a robot; and moving the reservoir and the dispenser between a dispensing location and the docking station by action of the robot.

6. The method of claim 5, further comprising:

controlling movement of the adhesive liquid dispensing apparatus with a control system; and moving the reservoir and the dispenser between the docking station and a dispensing location in response to a signal communicated from the control system to the robot.

7. The method of claim 1, further comprising:

automatically moving the reservoir and the dispenser from the docking station to a dispensing location after refilling the reservoir.

8. The method of claim 1, further comprising:

automatically coupling the reservoir and the dispenser to the docking station.

* * * * *